US005446939A

United States Patent [19]

Park

[11] Patent Number: 5,446,939

[45] Date of Patent: Sep. 5, 1995

[54] SHOE CLEANING CYLINDRICAL BRUSH

[76] Inventor: Joseph H. Park, 8445 Mandarin Ave., Rancho Cucamonga, Calif. 91730

[21] Appl. No.: 235,986

[22] Filed: May 2, 1994

[51] Int. Cl.[6] ..... A47L 23/06; A46B 13/02

[52] U.S. Cl. ..... 15/23; 15/28; 15/179

[58] Field of Search ..... 15/23, 24, 28, 29, 97.1, 15/179, 65, 71, 75, 34, 88.3, 184, 247

[56] References Cited

U.S. PATENT DOCUMENTS

| | | | |
|---|---|---|---|
| 2,882,538 | 4/1959 | Beeren | 15/24 |
| 3,307,211 | 3/1967 | Gaines | 15/23 |
| 4,016,617 | 4/1977 | Cardus | 15/29 |
| 4,848,946 | 7/1989 | Goncalves . | |
| 5,188,472 | 2/1993 | Sgro . | |
| 5,213,430 | 5/1993 | Pandola . | |
| 5,307,534 | 5/1994 | Miller | 15/23 |

*Primary Examiner*—Edward L. Roberts, Jr.

[57] ABSTRACT

The present invention is to remedy the cumbersome and messy operation in obtaining a quick shoe shine individually by providing a cylindrical brush. The cylindrical brush is utilized by attaching it to the motor operated screwdriver. The brush has a shape of a cylindrical body with the flat top and bottom. The cylindrical body and the flat top have bristles on them, but the bottom has shaft extending out to be attached to the motorized screwdriver. The bristles on the top portion of the cylindrical body are designed to be used as a polish applicator to the shoe. To the top portion of the cylindrical brush, there is a covering wall having a smaller cylindrical shape which is inserted into the body of the brush from the top with handle extended out onto the surface of the side controlling the covering wall. Also provided is a top brush lid instead of the covering wall to fit over the brush on the top.

1 Claim, 2 Drawing Sheets

SHOE CLEANING CYLINDRICAL BRUSH

FIELD OF THE INVENTION

The present invention relates generally to a shoe brush, and more particularly to a cylindrical shoe cleaning brush attachable to a commercially available motorized screwdriver.

BACKGROUND OF THE INVENTION

There are many shoe cleaning and polishing machines available, but they are mainly designed for commercial settings because of its size and cost of manufacturing. There are other brushes and cloths that are made to meet the needs of individuals who want a quick shoe shine by providing a personalized shoe caring kit which comes with brush, shoe polish, and a cloth. These kits are relatively economical compare to the machines and personalized, but still it is a relatively cumbersome and messy operation to obtain a quick shoe shine.

Following are some of the personalized shoe shine kit disclosed in U.S. Patent. U.S. Pat. No. 5,213,430 to Pandola entitled "Combination Shoe Brush and Liquid Applicator" issued on May 25, 1994 discloses a combined shoe brush and liquid container that has an atomizer head attached. The shoe brush has a conforming opening on one end to allow the engagement of a like conforming liquid container; U.S. Pat. No. 5,188,472 to Sgro entitled "Shoe Polish Application Kit" issued on Feb. 23, 1993 discloses a shoe care kit that simplifies the process of shoe polishing by virtue of consolidating conventional shoe shine components such as a brush applicator and/or polishing cloth into a convenient compact storage container; and U.S. Pat. No. 4,848,946 to Gonclaves entitled "Dispensing Container Including a Brush-Type Applicator" issued on Jul. 18, 1989 discloses a container that includes an applicator of simple construction that is adaptable for all kinds of containers. These patent lettered inventions focus on compacting the applicator and the polishing cloth instead of simplifying the usage of the brush and polisher by simplifying and providing a new and improved method of personal shoe shining.

SUMMARY OF THE INVENTION

The principle object of this invention is to remedy the cumbersome and messy operation in obtaining a quick shoe shine individually by providing a cylindrical brush. The cylindrical brush is utilized by attaching it to the motor operated screwdriver. The brush has a shape of a cylindrical body with the flat top and bottom. The cylindrical body and the flat top have bristles on them, but the bottom has shaft extending out to be attached to the motorized screwdriver. The bristles on the top portion of the cylindrical body are designed to be used as a polish applicator to the shoe. To the top portion of the cylindrical brush, there is a covering wall having a smaller cylindrical shape which is inserted into the body of the brush from the top with handle extended out onto the surface of the side controlling the covering wall. Also provided is a top brush lid instead of the covering wall to fit over the brush on the top.

It is an object of the present invention to provide a cylindrical shoe brush that is used by attaching to the motorized screwdriver.

It is a further object of the present invention to provide a portable and personalized shoe cleaning brush.

It is a still further object of the present invention to provide a shoe cleaning brush that is inexpensive and personalized to quicken and cleaner process of shoe shining.

These together with other objects of the invention, along with the various features of novelty which characterize the invention, are pointed out with particularity in the claims annexed to and forming a part of this disclosure. For a better understanding of the invention, its operating advantages and the specific objects attained by its uses, references should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF TEE PREFERRED EMBODIMENT

Figure 1:
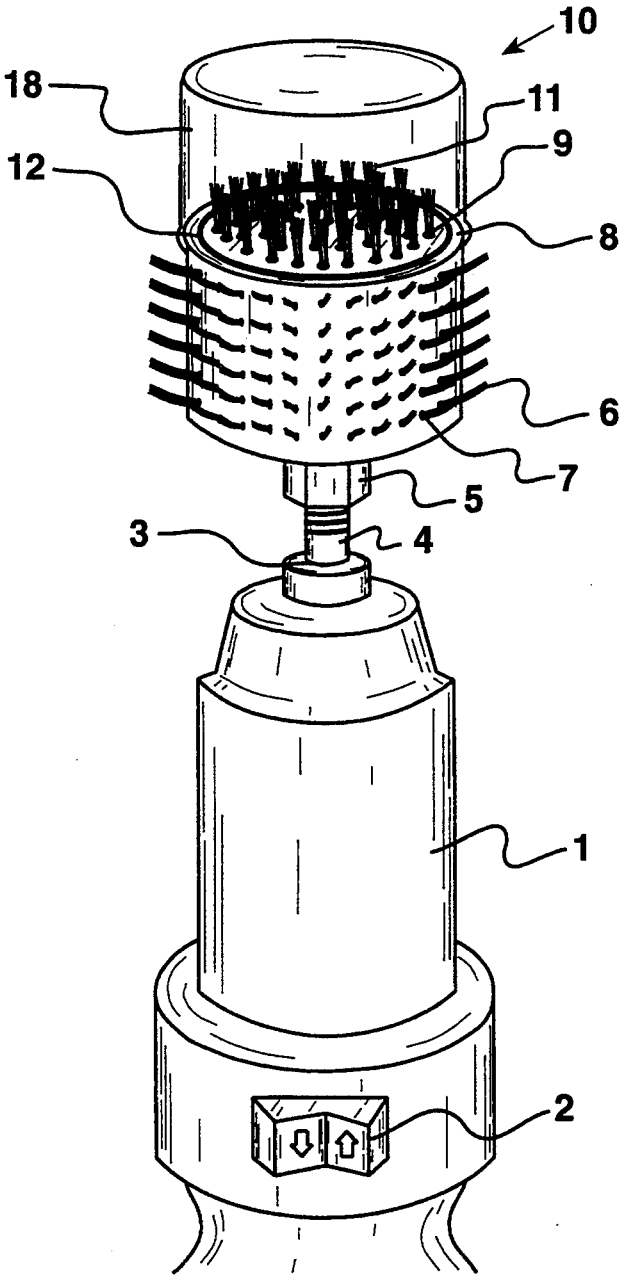
FIG. 1 is a drawing of a cylindrical shoe cleaning brush with a top lid attached to the motorized screwdriver according to the present invention.

Now referring to FIG. 1, there is a drawing showing a cylindrical brush 10 attached to the motorized screwdriver 1 by the shaft 4 of the brush inserted into the shaft receiver 3 of the motorized screwdriver. The cylindrical brush 10 is attached to the screwdriver 1 by the brush shaft 4, held at its place by washer 5 tightly screwed on, inserted into the shaft receiver 3. The brush shaft 4 is made to have its length adjustable according to the need of the user. The switch button 2 activates and deactivates the motor of the screwdriver 1 to rotate and spin. As the button 2 is pressed, the cylindrical brush 10 starts to spin towards predetermined direction.

Figure 2:
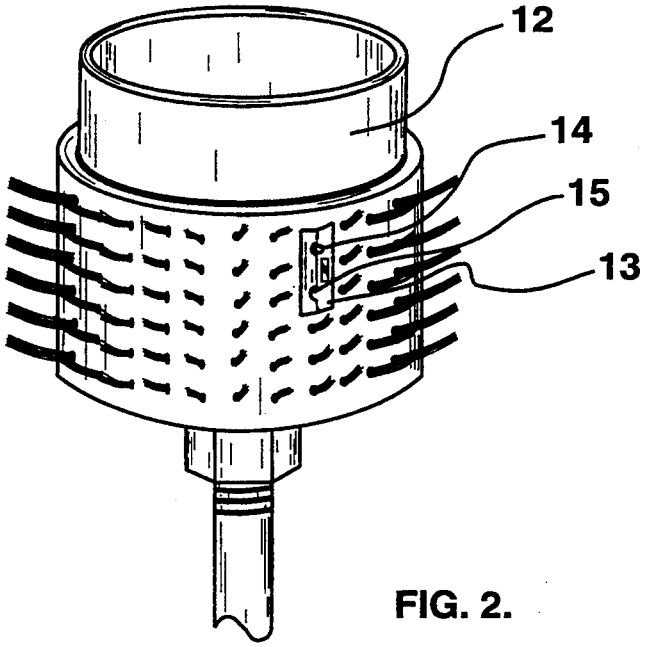
FIG. 2 is a drawing of a cylindrical shoe cleaning brush showing the top covering wall with its handle at lifted position.

According to FIGS. 1 and 2, there show a cylindrical brush 10 with bristle openings 7 on the side where bristles 6 are placed extending outwardly. Further, unto the top 8 of the cylindrical brush, there are bristle openings 9 and bristles 11 inside the opening extending outwardly. The bristle openings 9 on the top 8 of the cylindrical brush 10 are bounded by the circular edges of covering wall 12. The covering wall 12 is shown at lowered state with its handle down. The cylindrical brush is made of wood, plastic, and steel-like materials.

Figure 3:
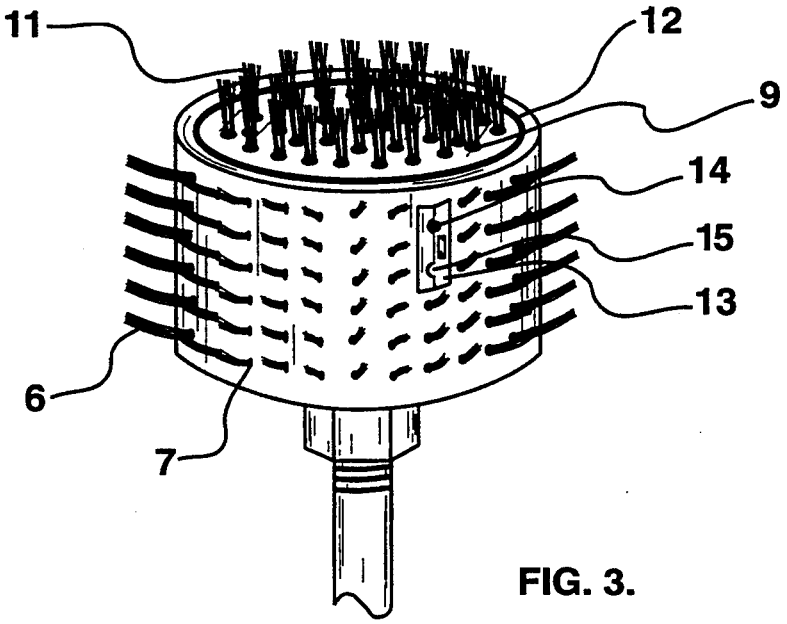
FIG. 3 is a drawing of a shoe cleaning brush showing the top covering lowered to expose the bristles on the top portion.

FIGS. 2 and 3 show drawings of a cylindrical shoe shining brush 10 showing covering wall 12 at lifted position over the top bristles 11 in FIG. 2 and lowered position exposing the top bristles. 11 to be used as a shoe polish applicator as shown in FIG. 3. To lift and lower the covering wall 12, a handle 14 having a shape of a ball attached to the surface of the body, is located within the area of bristles 6 with handle path 13 and handle hooks 15. The handle 14 is attached to the covering wall 12 as one unit. The handle 14 is pushed up to have the covering wall 12 cover the top bristles 11 and visa versa to lower the covering wall 12 to expose the top bristles 11. The handle 14 hooks into the handle hooks 15 to securely hold the covering wall 12 at its desired position.

As to the manner of usage and operation of the instant invention, the same should be apparent form the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cylindrical shoe cleaning brush comprising:

a cylindrical body;

bristles protruding from the circumference of said cylindrical body;

bristles protruding from the top of said cylindrical body;

a shaft extending from the bottom of said cylindrical body;

a handle with a hole which receives said shaft;

a motor within said handle which rotates said cylindrical body by means of said shaft;

a lid covering the bristles on the top of said cylindrical body.

* * * * *